United States Patent [19]

Jones

[11] 3,975,564

[45] Aug. 17, 1976

[54] RESILIENT SPACER PAD FOR AN ARTICLE IN A BOX

[76] Inventor: William C. Jones, 3 Grady Lane, New York, N.Y. 11727

[22] Filed: Sept. 13, 1974

[21] Appl. No.: 505,879

[52] U.S. Cl. ..... 428/174; 206/521; 229/14 C; 229/DIG. 1; 248/345.1

[51] Int. Cl.[2] ..... B32B 1/00; B65D 81/04

[58] Field of Search ..... 248/188.8, 345.1; 161/125, 130; 229/14 C, DIG. 1; 206/521; 428/174, 179

[56] References Cited

UNITED STATES PATENTS

| | | | |
|---|---|---|---|
| 2,476,197 | 7/1949 | Kincaid | 229/14 C |
| 2,509,468 | 5/1950 | Anderson | 229/14 C |
| 3,137,087 | 6/1964 | Shroyer | 248/345.1 |
| 3,220,683 | 11/1965 | Doll | 248/345.1 |
| 3,404,827 | 10/1968 | Carmody | 206/521 |
| 3,655,113 | 4/1972 | Carroll | 229/14 C |

FOREIGN PATENTS OR APPLICATIONS

| | | |
|---|---|---|
| 1,224,493 | 1971 | United Kingdom |

*Primary Examiner*—Marion E. McCamish
*Assistant Examiner*—P. J. Thibodeau
*Attorney, Agent, or Firm*—Brooks Haidt Haffner & Delahunty

[57] ABSTRACT

A pad is provided made from resilient sheet material and of single sheet thickness or cross section. The pad is, in general, in the overall form of a frustum having a socket for receiving an article to space it from its outer box, the pad being positioned angularly at the box corner. Further, the pad is flexibly deformable to cushion the article on impact. In use in a box, four pads are placed in the bottom corners of the box; the article is then guidedly slid into seated engagement with the sockets of the pads; and then, the top four pads are placed on the top of the article, after which the top of the box is closed. The pads are stackable in nested condition, thereby facilitating storage and shipment to the point of use.

7 Claims, 13 Drawing Figures

24

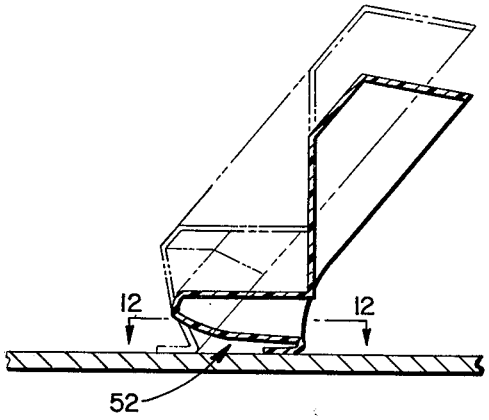
FIG. 11
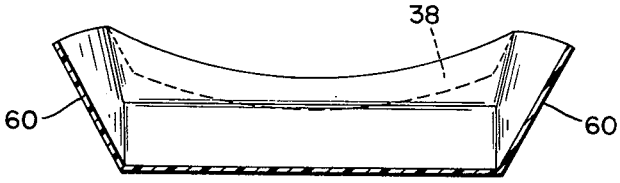
FIG. 12
FIG. 13
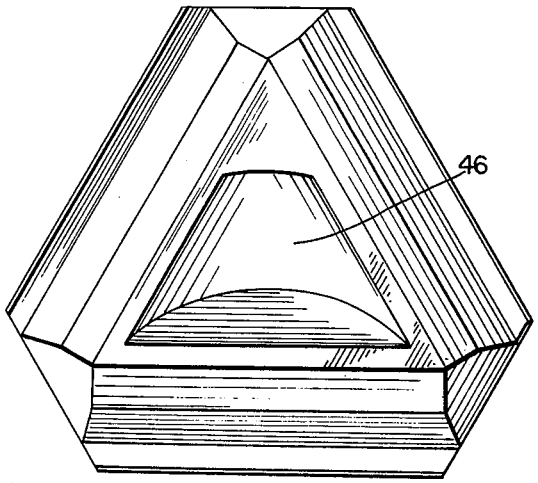

RESILIENT SPACER PAD FOR AN ARTICLE IN A BOX

BACKGROUND OF THE INVENTION

Resiliently deformable pads for the cradling and cushioning of articles in boxes are available. However, they are usually bulky, expensive to manufacture and to ship and to store, somewhat difficult to use, and somewhat lacking in adaptability to the variables encountered in the box and article shapes and shock resistance required.

As will become apparent, the resilient pad of single sheet thickness of the instant invention cradles and cushions an article within a box and has none of the drawbacks of the prior art.

The details of the pad elements and functions thereof will be understood from the following and the drawings, wherein:

FIG. 11 is a sectional view taken on line 11—11 of FIG. 5 with the dotted lines showing an undeformed pad and the full lines showing a deformed pad;

FIG. 12 is a sectional view taken on line 12—12 of FIG. 11; and

FIG. 13 is a top plan view of a pad having a curvilinear socket wall.

Figure 2:
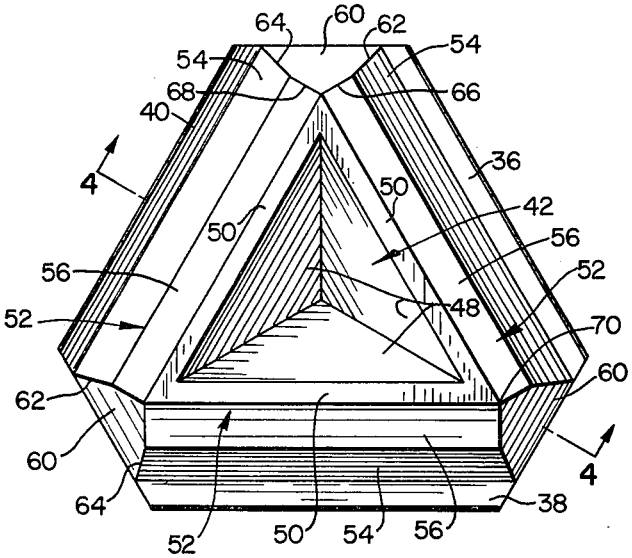
FIG. 2 is an enlarged top plan view of the socket face of FIG. 1.
Figure 1:
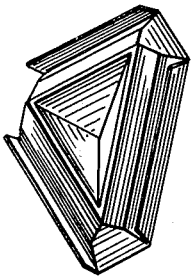
FIG. 1 is a perspective view of an equilateral pyramidal frustum type pad showing an equilateral pyramidal socket.
Figure 3:
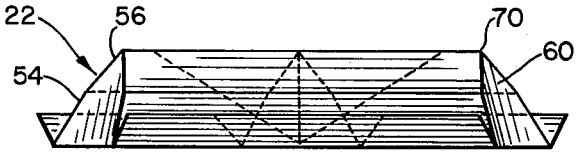
FIG. 3 is a side view of FIG. 2, looking at the bottom portion of FIG. 2.
Figure 4:
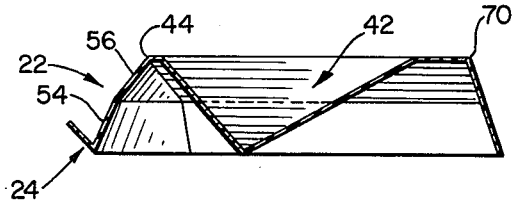
FIG. 4 is a sectional view taken on line 4—4 of FIG. 2.

Of pertinency in considering this invention are the U.S. Pat. No. 3,655,113 of 1972 to Carroll showing a rigid single sheet corner protector, and the British patent No. 1224493 to Townsend of 1971 showing a closed hollow member with right-trihedral form in FIG. 5.

The drawings of this invention show a pad made from resilient sheet material of aboutsingle sheet thickness in cross section of its elements. The pad may be fabricated by usual methods, such as integrating or connecting the elements, injecting molding, vacuum drawing and the like. The material used may be a resilient sheet material of polyethylene, metal, and the like. The resilient characteristics and compliance of the pad can be tailored to the need by mateial formulation, thickness of various elements, size and shape of elements, and compliance of the junctures or hinges between elements.

Basically, the pad is designed for use between an outer box corner 18 and an inner article (not shown), the corner trihedral walls 20 and the article being of various shapes.

Some of the terms used are based on known definitions in geometry and solid geometry. For example, a frustum is that part of a cone-shaped article next to the base, usually formed by cutting off the top in a plane parallel to the base. Also, a cone is any surface traced by a moving straight line which passes through a fixed vertex, thereby a curved surface or a many sided surface such as a pyramid is defined. And, a trihedral corner is a corner having three walls.

As seen in the drawings, each pad comprises:

1. an outside or outer base means 22 in the form of a frustrum and having outer base edge means 24 adapted to contact the trihedral walls of the box corner angularly between adjacent box wall junctures 26, 28, 28, and an inner edge 44;
   the outer base edge means 24 includes base edges 30, 32, 34 and ski feet 36, 38, 40 respectively, extending beyond the base edges; and
2. a shaped socket 42 for receiving
   an article, the socket 42 being integrated, that is connected, to the inner edge 44 contiguous with and bounded by the outer base means 22.

Figure 9:
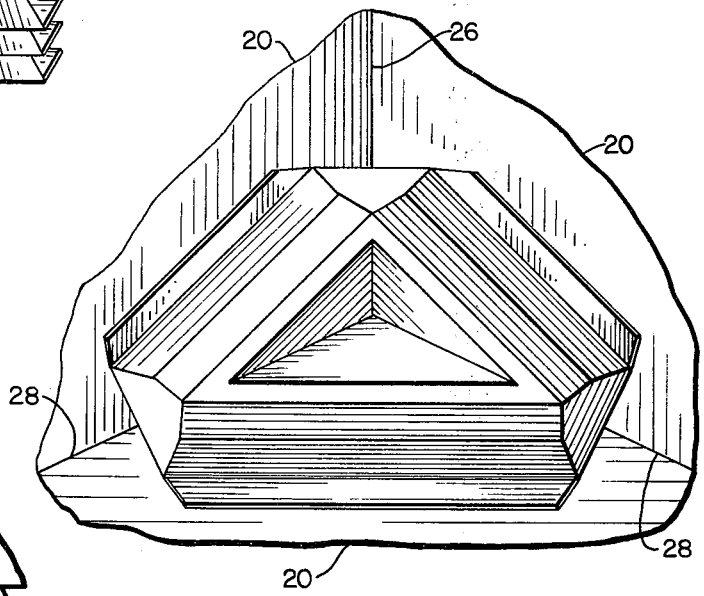
FIG. 9 is a top plan view of an isosceles triangular pyramidal socket similar in view to FIG. 2 and showing the box corner in which it sits.

It will be noted further that frustum can be in the form substantially of an equilateral triangular pyramidal frustum and the socket 42 can be of various forms such as curvilinear (see FIG. 13, curved wall 46) or a rimmed isosceles triangular pyramid of FIG. 9 or rimmed equilateral triangular pyramid of FIG. 2. The socket 42 includes article contacting means 48 and a continuous rim 50 which extends beyond the inner of the wall means 48 to the inner edge of the outer base means 22, rim 50 providing a guiding slide for ease in article insertion.

Figure 6:
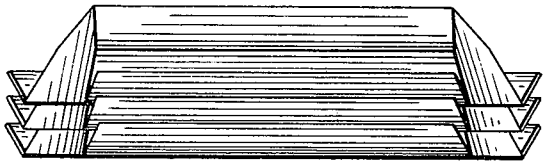
FIG. 6 is a view of a stack of nested pads with surfaces in almost face-to-face contact.

The pads are stackable in nested face-to-face condition as suggested by FIG. 6, thereby reducing space consumption and cost.

Attention must be given to proper orientation of pads which have sockets 42 of special design and/or base means 22 of special design, such as the forty-five degree isosceles triangle design of FIG. 9.

Such orientation attention is not required in use of the pad shown in FIGS. 1–5, 7, 8, 10–12 in that it is designed for use in a box corner having trihedral right-angled walls with internal vertical and horizontal junctures 26, 28, 28 respectively. The outer base means 22 is in the form substantially of an equilateral triangular pyramidal frustum having three side walls 52, 52, 52 substantially equal in height and length. Each side wall 52 has a planar outer panel 54 and a planar inner panel 56 extending angularly inwardly therefrom. In effect, the panels 54 and 56 define frustums, the inner frustum having a closer apex; however, the two frustums are broadly viewed as defining the basic substantially frustum form of the outer base means 22.

Figure 5:
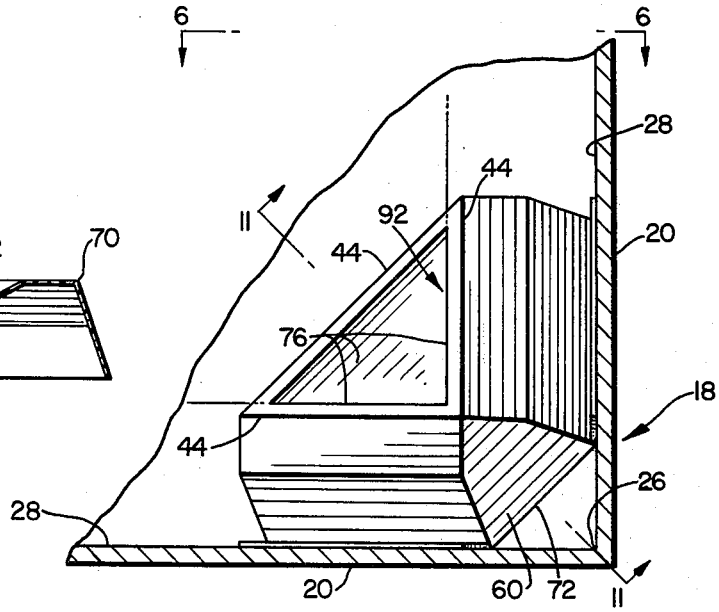
FIG. 5 is a top view of the pad installed in a bottom box corner.
Figure 7:
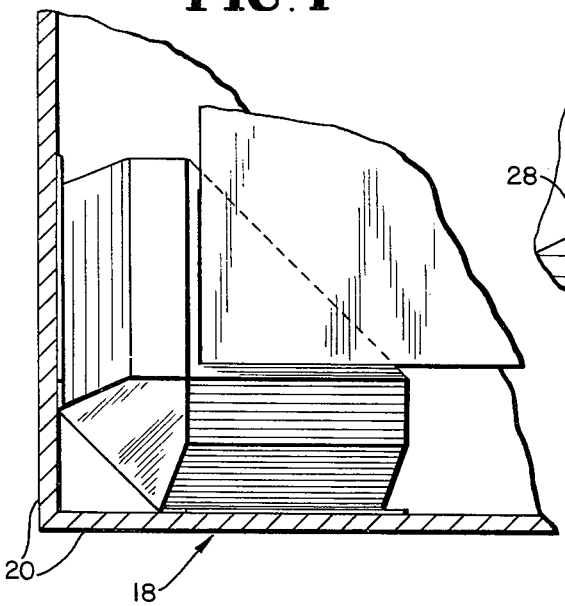
FIG. 7 is a front view of a pad installed in a box bottom corner taken on line 6—6 of FIG. 5.
Figure 10:
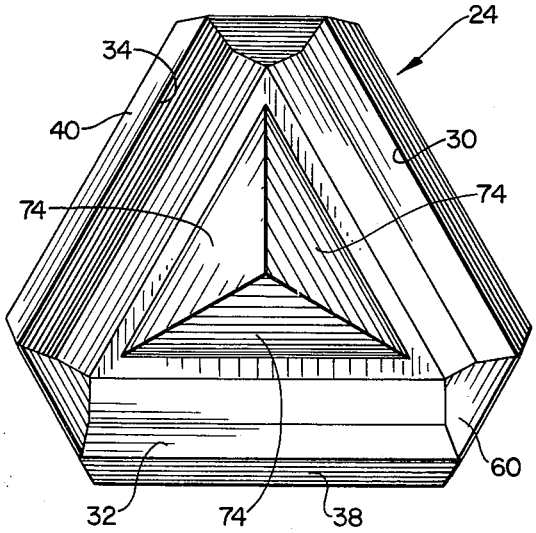
FIG. 10 is a bottom plan view of FIG. 2.

The ends of the panels 54 and 56 are joined or integrated by planar barn-shaped plates 60 which span the box corner 18 at a forty-five degree angle as seen in FIGS. 5 and 7, the straight outer base end 72 of each plate 60 being closest in spanning the box junctures 26, 28, 28. Each barn-shaped plate 60 has slanted barn wall edges 62, 64 and more slanted barn roof edges 66, 68 which terminate in the barn roof apex peak 70. The barn wall edges 62, 64 are joined to the ends of adjacent outer panels 54, 54 and the barn roof edges 66, 68 are joined to the ends of adjacent inner panels 56, 56. Preferably, the inner edge 44 formed by the three inner panels 56, 56, 56 extends through the three barn roof apex peaks 70, 70, 70 to define a triangular peripheral edge in a plane parallel to and internally concentric with the base edges 30, 32, 34.

The shaped socket 42 has three equilateral right-angled trihedral walls 74, 74, 74 forming a pyramidal socket (see bottom view of FIG. 10) for receiving a similarly shaped corner of an article. Socket 42 has socket base means 92 which includes base legs 76, 76, 76 and a continuous or unbroken rim 50 which extends beyond the legs and is joined to the straight inner edge 44. Preferably, the rim 50 is in the same plane as the triangular inner edge 44.

In use, the specific pad design of FIGS. 1–5 is placed in the bottom box corners with the sockets 42 facing each other to receive an article. The article is dropped into the box and the slanted rim 50 assists in guiding the article into full seated position, guiding being especially done by the top portion of the rim 50. The frictional engagement of the base edges 30–34 and ski feet 36, 38, 40 (all being roughned and/or lightly glued in place) along with the 60° angle with the horizontal positioning of the equilateral right-angle pad inhibit pad movement and enable full article seating without difficulty. The pad of FIG. 5 can be dropped into the box corner without concern of angular orientation as distinguished from the 45° pad of FIG. 9 and the curvilinear pad of FIG. 13 The top pads are then placed on the article and the box top closed.

Figure 8:
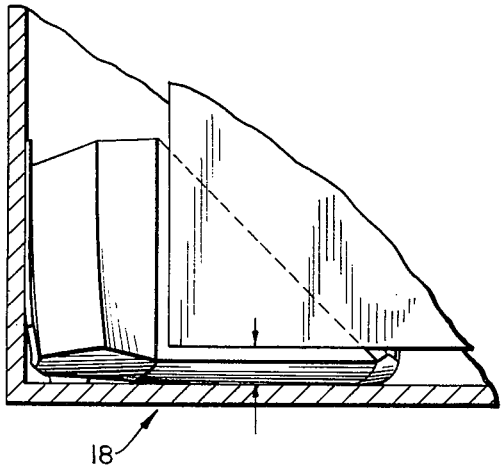
FIG. 8 is a view similar to FIG. 7 with the pad at an almost completely elastically deformed condition.

Under impact, the response of the resilient pad is a function of many variables; however a direct vertical drop causing a fully compressed condition of the pad is illustrated by the front views of FIGS. 7 and 8. The downward movement of the pad side elements along the box and the resilient flexing of the bottom elements due to impact are shown in FIG. 8. It will be noted that the barnshaped plate 60 acts as a hinging member. FIG. 11 gives a cross sectional view of the movement of the elements of the pad, a before and after showing of a partial resilient deformation. And FIG. 12 is a showing of the controlling effect of the barn-shaped plates 60 and also the ski foot 38 movement on the movement of the other elements during deformation.

The pad of FIGS. 1–5 is a 2 to 2½ inch pad with the bottoming out shown in FIG. 8 involving a flexing of bottom elements to about a ⅝ inch height as indicated by the arrows, this being about an 85% maximum deformation. Pads of ranges such as 20–40, 60–80, 100–120 pounds are envisioned. The barn-shaped plates 60 can be used to regulate trapped air exhaust by changing the shape of the barn-shaped foundation edge 72 to reduce or enlarge the air passages.

It will be recognized that the pad elements are hingedly joined, preferably by a vacuum forming process using a sheet of material. Certain elbows or hinge connections or junctures can be thinned to be more responsive to impact deformation.

I claim:

1. A pad of resilient material having single sheet thickness adapted for use as a resilient spacer positioned between an outer corner of a box or the like and an inner article, the corner of the box having trihedral walls with three junctures between the walls; said pad comprising:

outer base sidewalls in the form substantially of a frustum and having an outer base edge adapted to contact the trihedral walls angularly between adjacent box wall junctures when seated in the box corner, said outer base means having an inner edge disposed inwardly of said outer base edge; and a shaped socket disposed inwardly of said inner base edge for receiving an article, said socket being integrated with said inner edge, contiguous with and bounded by said outer base.

2. A pad as defined in claim 1, and wherein said outer base edge means includes three base edges, each having a ski foot extending beyond its respective base edge for frictional sliding contact with its respective box wall.

3. A pad as defined in claim 2 and wherein said frustum is in the form substantially of an equilateral triangular pyramidal frustum.

4. A pad as defined in claim 1 and wherein said socket includes a curvilinear wall.

5. A pad as defined in claim 1 wherein said socket includes an article contacting wall means and a continuous peripheral rim extending beyond the inner end of said wall means to the inner edge of said outer base means.

6. A pad as defined in claim 5 and wherein said outer base means is an equilateral triangular pyramidal frustum and said socket is of the form of a rimmed equilateral triangular pyramid.

7. A pad formed from a single sheet of resilient material and adapted for use as a resilient spacer positioned between an outer corner of a box or the like and an inner article, the corner of the box having trihedral rightangled walls with internal vertical and horizontal junctures therebetween, said pad comprising:

outer base means in the form substantially of an equilateral triangular pyramidal frustum having three side walls substantially equal in height and length, each side wall having a planar outer panel and a planar inner panel extending angularly inwardly therefrom, planar barn-shaped plates extending between the ends of the side walls, each outer panel having an outer base edge means including a base edge and a ski foot extending beyond the base edge, said ski foot being adapted for frictionally contacting a box wall at a 60° angle between adjacent junctures of the box corner, said inner panel having a straight inner edge, the three inner edges extending substantially through the apexes of the barn-shaped plates to define an equilateral triangular peripheral edge in a plane parallel to and internally concentric with said base edges, the apex plates having straight outer ends adapted to span in spaced relation the junctures of the box corners; and a shaped socket having three equilateral trihedral walls forming a pyramid for receiving an article, said socket having socket base means including base legs and a continuous peripheral rim extending beyond said legs to said straight inner edges of said inner panels to provide a slide to the socket, the apex of the socket being positioned centrally in the plane of said base edges of said frustum.

* * * * *

UNITED STATES PATENT AND TRADEMARK OFFICE

CERTIFICATE OF CORRECTION

PATENT NO. : 3975564

DATED : August 17, 1976

INVENTOR(S) : William C. Jones

It is certified that error appears in the above-identified patent and that said Letters Patent are hereby corrected as shown below:

Column 1, line 63, "mateial" should read --material--

Column 4, line 34, "rightangled" should read --right-angled--

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*